United States Patent [19]

Podrini

[11] Patent Number: 4,661,230

[45] Date of Patent: Apr. 28, 1987

[54] RADIAL CELL ELECTROPLATING DEVICE

[75] Inventor: Maurizio Podrini, Rome, Italy

[73] Assignee: Centro Sperimentale Metallurgico SpA, Rome, Italy

[21] Appl. No.: 886,095

[22] Filed: Jul. 16, 1986

[30] Foreign Application Priority Data

Aug. 12, 1985 [IT] Italy ..... 48471 A/85

[51] Int. Cl.[4] ..... C25D 17/00

[52] U.S. Cl. ..... 204/206

[58] Field of Search ..... 204/206

[56] References Cited

U.S. PATENT DOCUMENTS 3,634,223 1/1972 Carter ..... 204/206

*Primary Examiner*—T. M. Tufariello

*Attorney, Agent, or Firm*—Young & Thompson

[57] ABSTRACT

Radial cell electroplating device, especially suitable for high current density electrodeposition of metals and metal alloys, wherein the arrangement for feeding the electrolyte to the cell and for discharging it therefrom permits instantaneous regulation of electrolyte flow direction and velocity parameters simply by adjusting valves, so as to adapt those parameters to the movement conditions of the strip to be plated, at the current density used and the prevailing electrolyte aeration conditions, so as to optimize the quality of the product obtained.

3 Claims, 2 Drawing Figures

RADIAL CELL ELECTROPLATING DEVICE

DESCRIPTION

Figure 1:
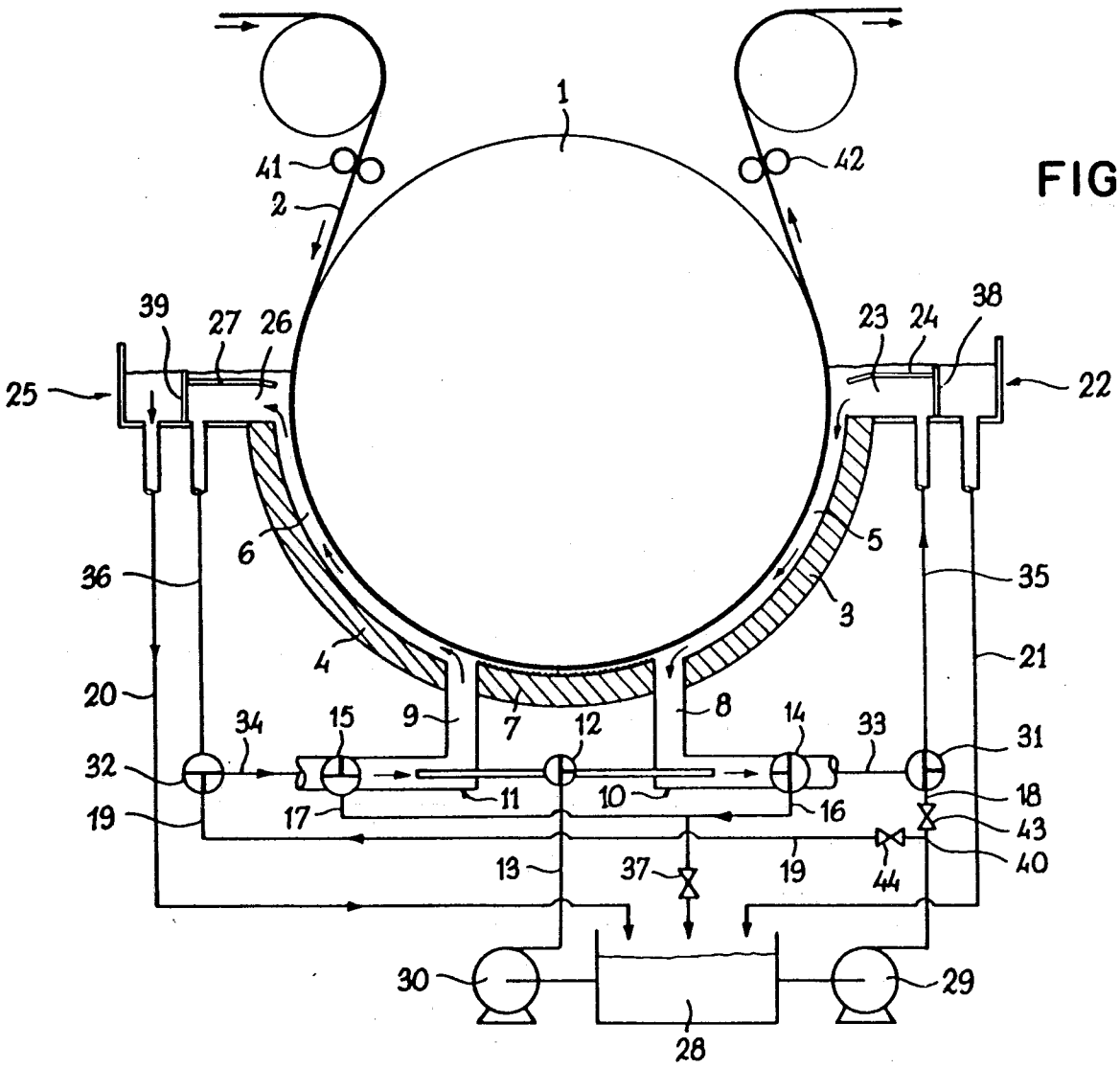

This invention concerns a radial cell electroplating device. More precisely it concerns a device that is especially suitable for high current density electrodeposition of metals and metal alloys, permitting regulation of the electrolyte flow conditions so as to optimize the plating process and the quality of the coating obtained.

In the continuous electrodeposition of metals or metal alloys on metal strip, especially steel strip, high current density processes involving current densities of over 50 $A/dm^2$ are rapidly gaining ground; at the present time densities have reached 80–120 $A/dm^2$, but it is expected that considerably higher values will be employed in the future.

It is known, of course, that while high current densities permit high deposition rates to be attained, it is also necessary to ensure that the electrolyte has a considerable velocity relative to the strip to be plated, so as to minimize the thickness of the layer of electrolyte impoverished in metal ions for deposition, in contact with the metal strip. Only in this manner, in fact, can the speed and efficiency of the electroplating process be maintained.

However, in such deposition processes where high process efficiency and consistently high product quality are required, together with low production costs, of course, a whole series of operating parameters must be optimized, some of the main ones being constant parallelism between strip (cathode) and counterelectrodes (anodes), voltage drop between electrodes and along the strip itself, electrolyte flow conditions, degree of electrolyte aeration resulting from evolution of gas at the anodes, and current density.

As regards the parameters that are obviously recognisable as important at first sight, namely parallelism between electrodes and voltage drop, a very effective answer has come through the introduction and improvement of what are known as radial cells. In these devices, in fact, a large rotating drum is partially immersed in the electrolyte and the metal strip to be plated is in close contact with the submerged part of the drum and is moved together with it. A short distance away from the drum surface are the anodes; the electrolyte is made to pass in the space between the drum—and hence the strip—and the anodes. As the strip is held tightly against the submerged surface of the drum the problem of maintaining a constant distance between strip and anodes is resolved. Then either the drum can act as the conductor or else current-carrying rollers can be positioned in contact with the strip very close to the point where this enters the electrolyte; in this way the voltage-drop problem is also overcome.

The other problems, however, especially those concerning electrolyte velocity and aeration have been recognized as such only recently, and so far no satisfactory solution has been found.

It has been demonstrated that plating quality, and in the case of alloy electrodeposition, the uniformity of its composition depend on uniformity of relative velocity between strip and electrolyte. It has also been recognized recently that a fixed relationship must be maintained between current density and electrolyte turbulence, in order to obtain a very high quality coating (see Italian Patent Application No. 48371-A/85 of 18 July 1985).

All these constraints mean that the existing data and proposals on the state of the art are quite inadequate to guarantee attainment of products of sufficiently high quality to justify the very sophisticated nature of the plants and processes involved, and also the relevant costs.

In fact, to ensure an adequate cell length for commercial electroplating it is necessary to have drums of very large diameter, two meters for instance, so that the circumferential length of the submerged half is about three meters, and this is too long to permit a regular, constant flow of electrolyte throughout the cell (bearing in mind that the strip may be as much as 1.8 m wide and that the space between the electrodes ranges from 6–8 mm to 2.5–3 cm at most). Furthermore, this great length does not permit effective dispersion of the gas inevitably given off at the anodes. To overcome these difficulties, the electrolyte is fed into the lowest part of the tank containing the drum and is divided into two streams which rise to lap the cylindrical surface of the drum in a direction perpendicular to its generatrices. Yet even this arrangement is not satisfactory, since on the one side the electrolyte meets the strip moving in the opposite direction while on the other the two meet moving in the same direction, so the requirement that there should be constant relative velocity is obviously not respected.

Proposals have therefore been made for arrangements whereby the drum is surrounded by a number of chambers containing the electrolyte whose movement is controlled chamber by chamber. This set-up appears too complex and difficult to balance, however, to ensure trouble-free operation on any plant.

Proposals have been made, too, for plants in which one of the two streams of electrolyte around the drum is fed from the bottom and the other from the other from the top, so as to attain the desired uniformity of relative velocity between strip and electrolyte. With this solution, however, the drum must be used to feed the current to the strip and this does not appear to be a satisfactory solution, for a variety of reasons. In the case, instead, where the current is fed via pressure rollers in contact with the strip upstream and downstream of the drum, it ensues that in the stretch where the electrolyte flows from bottom to top, the maximum build-up of anode gas occurs close to the point where the current is passed into the strip, which is where the voltage drop is minimum and the counterposed effects of gas concentration and minimum voltage drop compensate one another. In the other stretch, however, the opposite situation occurs and there is maximum gas concentration where there is the maximum voltage drop on the strip. It will be readily understood that the deposition processes in the two stretches thus take place under different conditions, so the deposits are also different and there is a decline in the general quality of the finished product.

Then, too, there is the fact that radial cell devices can only plate one side of the strip, namely that which is not in contact with the drum. But the market also requires considerable quantities of two-side plated strip. As a result, radial electroplating plants have been built for plating both sides, with the strip rotated through 180°, running in the opposite direction to the original one, through the same group of cells or a group parallel thereto. This last solution is unsatisfactory economically, however, because the second section of the plant only works when two-side strip is needed. Furthermore, flow conditions during plating of the second side are the opposite of those for coating the first, giving rise to all those adverse effects on final product quality already referred to.

Having thus exhausted the possibilities of reciprocal movement between strip and electrolyte, as well as the possibility of feeding current to the strip to be plated, without having found satisfactory solutions to the question of maximizing the quality of the resulting product, it is evident that as things stand at present radial cell electroplating devices can be utilized only in special, restricted process conditions, unless those concerned are prepared to accept a product of inferior, variable quality.

It is the specific object of this invention to provide a radial cell electroplating device that can be used satisfactorily under a variety of operating conditions (strip speed, current density and electrolyte aeration).

For this purpose a structural solution is suggested, as per this invention, that is based essentially on the observation that—other conditions being equal (and provided that the electrolyte has a certain velocity, so that flow is sufficiently turbulent)—in order to achieve optimum quality coatings at high current density, there must be a certain relative velocity between strip and electrolyte, but only the absolute value of this relative velocity is important, not the direction of electrolyte flow vis-à-vis the strip.

This concept has opened up completely new prospects for radial-cell electroplating plants, allowing electrolyte flow in the electroplating zones to be oriented in any direction that proves convenient to ensure the yield and general efficiency of the process.

There thus ensues a technical innovation consisting in the specific indication as to the arrangement of the means of circulating the electrolyte so as to permit easy control of its flow direction and velocity.

The specific object of this invention, therefore, is a radial cell electroplating device consisting of a horizontal shaft rotating drum which pulls along the strip to be plated that is in contact with its cylindrical surface, and sets of electrodes arranged in pairs facing towards the cylindrical surface of the drum so as to form together with the strip surface two channels traversed by the strip, one from top to bottom—known as the descending channel—and the other from bottom to top—known as the ascending channel—, said electrodes terminating downwards some distance apart, and also complete with at least one pair of conduits, set in the lower terminal part of said electrode units, for the forced passage of electrolyte within said descending and ascending channels, characterized by the fact that the conduits of each pair have tubular means for feeding ejectors positioned in each of said conduits to draw electrolyte through said descending and ascending channels, from a tank set above the channels and in communication therewith, each of said conduits having means for feeding electrolyte in the opposite direction to the one in which said ejectors operate to force the electrolyte from said conduits through said descending and ascending channels to said tank, and also being complete with cooperating means to ensure that in said ascending and descending channels the electrolyte flow is in the established direction and at the desired velocity. The ejectors of each of said pairs are fed preferably by the same feeder through a three-way valve, so as to be able to supply one or other or both or neither of the ejectors.

To regulate the direction and velocity of electrolyte flow in both the ascending and descending canals independently of one another and to suit actual process conditions, provision is made for appropriate means consisting essentially in three-way valves, means for regulating the flows of the necessary pumps, and flow-control valves. Preferably, said conduits are also interconnected by means of three-way valves downstream of said ejectors, and piping connecting said three-way valves, said piping also having the possible function of by-pass for the three-way valves feeding the ejectors.

The invention will now be explained in greater detail through two possible embodiments illustrated in FIGS. 1 and 2, purely by way of exemplification without limiting the invention or claims thereto.

In FIG. 1 drum 1, rotating around its own axis, pulls along strip 2 which thus moves in the direction of the arrows, following a descending path in channel 6, between anode 4 and drum 1, and then an ascending one in channel 5, between anode 3 and drum 1. Current-carrying rollers are indicated by 41 and 42. Electrodes 3 and 4 are connected at the bottom to conduits 8 and 9, respectively, and at the top to tanks 22 and 25, provided with separating baffles and overflows 38 and 39 which delimit reception zones 23 and 26 for the electrolyte which arrives via conduits 35 and 36. Any turbulence in and splashing from zones 23 and 26 is screened by elements 24 and 27.

According to the flow-diagram illustrated, the upper tanks 22 and 25, which are intercommunicating, are filled by means of pump 29 which delivers fresh electrolyte from tank 28 via tee 40, control valve 43 and pipe 35. In this way channel 5 is also filled. Pump 30 too sends fresh electrolyte from tank 28 via pipe 13 to three-way-valve 12 which, in the position illustrated, feeds ejector 10 that, in turn, via conduit 8 draws in fresh electrolyte from zone 23 via channel 5. Valve 14, in the position indicated, permits discharge via conduit 16 of the primary liquid of ejector 10 and of the secondary liquid drawn through conduit 8.

In this manner the right-hand side of the device, namely that of ascending channel 5, is activated and operative.

The left-hand side of the device, namely that of descending channel 6, in turn, is rendered active and operative in the following way.

The electrolyte delivered by pump 29 arrives at tee 40 and part of it is sent to pipe 19 (the flow rate being regulated by control valve 44) and via this to three-way valve 32 which, in the position indicated, sends the electrolyte in the opposite direction to that of operation of ejector 11, by means of pipe 34 and three-way valve 15, into conduit 9 from whence the electrolyte rises up channel 6 and zone 26, leaving there by overflow 39 and is delivered into tank 28 via conduit 20.

It should be noted that in practice tank 28 can be formed of a series of tanks and devices not solely for storage but also for purifying the electrolyte which returns from the electroplating cells—for instance to remove the gas that inevitably forms at anodes 3 and 4—and for restoring the optimum composition and pH of the electrolyte.

FIG. 1 of the accompanying drawings refers to a flow diagram in which electrolyte and strip for plating run countercurrent to one another.

It is readily understood, however, that by appropriately altering the settings of valves 12, 14, 15, 31 and 32, any desired electrolyte flow condition can be ensured in channels 5 and 6.

Thus, for instance, if it were necessary to obtain a two-side plated product, the strip could be rotated through 180° by an appropriate device and made to pass through the cells in the opposite direction to that referred to so far: in this case all that would have to be done would be to reverse the settings of valves 12, 14, 15, 31 and 32 to maintain completely countercurrent flow.

The foregoing does not, however, exhaust the possibilities offered by the invention to meet self-evident process requirements and/or product quality needs. Indeed, it has already been noted that a given relationship between fluid-flow state (turbulence) and applied current density must be maintained in order to obtain an excellent quality coating.

Assuming that the current density adopted and the general characteristics of the device means that the optimum relative velocity between electrolyte and strip is 2 m/s, if circulation is exclusively countercurrent, since it is necessary for the electrolyte to have a certain velocity, the maximum permissible strip velocities are relatively low, as little as about 1.5 m/s. Under such conditions, however, the electrolyte velocity does not permit sufficient dilution of the gas generated at the anodes, so process efficiency declines, as does product quality. In this case (FIG. 2) it suffices that in descending channel 6, circulation of electrolyte should be in the same direction as strip 2 but at a sufficiently high velocity to maintain the desired absolute relative velocity value.

Figure 2:
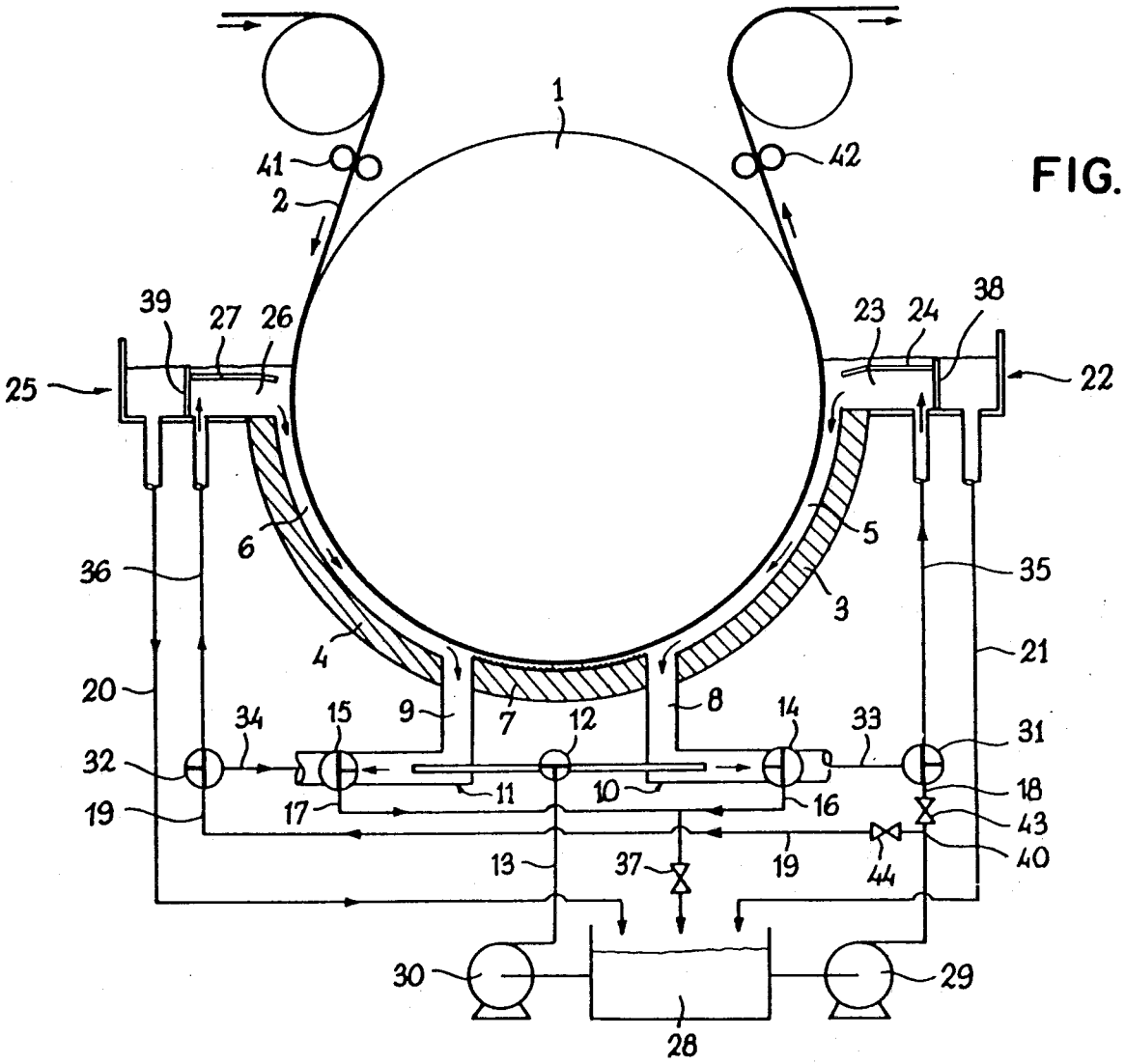

In the FIG. 2 configuration, the operation is performed by selecting settings of three-way valves 12, 14, 15, 31 and 32 such that the fluid pumped by 30 is fed to both ejectors via valve 12, drawing through conduits 8 and 9 the electrolyte coming from tanks 22 and 25. in the indicated configuration, three-way valves 31 and 32 are set to permit direct feeding of the electrolyte to tanks 22 and 25 via pump 29.

As can be seen, a differential convergent flow of electrolyte is ensured with this configuration.

A modern electroplating plant, however, may well adopt strip speeds of more than 2 m/s; it is evident that in these conditions, with the foregoing relative velocities between strip and electrolyte in no case will it be feasible to obtain a product of the best possible quality.

In such cases it will suffice to deliver the electrolyte in both channels at a sufficiently high velocity in the same direction as the strip to maintain the desired relative velocity.

Another possible arrangement is that which permits a divergent differential flow to be attained; here the electrolyte is delivered in both conduits 8 and 9 in the opposite direction to that in which ejectors 10 and 11 operate.

It is clear, therefore, that according to this invention, simply by changing the setting of a few three-way valves, it is possible to attain any desired and/or necessary electrolyte flow condition in the electroplating cells, while ensuring the highest quality product in all cases.

Finally, there is yet another way of utilizing the invention. If it should be necessary to produce a very thin coating, instead of eliminating a number of cells from the line, which may be difficult while maintaining the correct position of the coilers, with the device concerned it suffices to reduce the current density and hence the flow of electrolyte in the cells, utilizing only one of the ejectors, number 10 for instance, closing cutoff valve 37 and setting valves 15 and 14 so that the electrolyte coming from conduit 8 passes through pipes 16 and 17 and rises directly in conduit 9.

The last point to note is the function of part 7, which creates a separating space between channels 5 and 6; the surface of this part 7 facing the drum is closer thereto than are the surfaces of electrodes 3 and 4. This surface is also very rough so as to greatly increase the pressure drop of the fluid which leaks from the higher-pressure conduit to the lower pressure one. In this way leak-by flow rates equal to even less than 20% of the flow rate in the higher pressure branch have been recorded.

The invention has been described by reference to some forms of embodiment but it should be understood that variations and modifications may be made by experts in this field without however moving outside the bounds of protection that is provided.

I claim:

1. Radial cell electroplating device provided with a horizontal shaft rotating drum which pulls along the strip to be plated that is in contact with its cylindrical surface, and sets of electrodes arranged in pairs facing towards the cylindrical surface of the drum so as to form together with the strip surface two channels traversed by the strip one from top to bottom—known as the descending channel—and the other from bottom to top—known as the ascending channel—, said electrodes terminating downwards some distance apart, and also complete with at least one pair of conduits, set in the lower terminal part of said electrode units, for the forced passage of electrolyte within said descending and ascending channels, characterized by the fact that the conduits of each pair have tubular means for feeding ejectors positioned in each of said conduits to draw electrolyte through said descending and ascending channels, from a tank set above the channels and in communication therewith, each of said conduits having means for feeding electrolyte in the opposite direction to the one in which said ejectors operate to force the electrolyte from said conduits through said descending and ascending channels to said tank, and also being complete with cooperating means to ensure that in said ascending and descending channels the electrolyte flow is in the established direction and at the desired velocity.

2. Radial cell electroplating device as per claim 1, characterized by the fact that the ejectors of each pair are fed by the same feeder through a three-way valve.

3. Radial cell electroplating device as per claim 1, characterized by the fact that said conduits are interconnected by three-way valves located downstream of said ejectors and by piping connecting said three-way valves, said piping also having the possible function of by-pass for the three-way valves feeding the ejectors.

* * * * *